US005558572A

United States Patent [19]

Fletcher

[11] Patent Number: 5,558,572

[45] Date of Patent: Sep. 24, 1996

[54] PACKAGE/PEDESTAL FOR SHARPENING STONE

[75] Inventor: William J. Fletcher, Reno, Nev.

[73] Assignee: Eze-Lap Diamond Products, Inc., Carson City, Nev.

[21] Appl. No.: 280,361

[22] Filed: Jul. 26, 1994

[51] Int. Cl.[6] ..... B23F 21/03

[52] U.S. Cl. ..... 451/552; 451/490; 451/491; 451/523; 451/525

[58] Field of Search ..... 451/490, 491, 451/523, 524, 525, 540, 552, 557; 206/216

[56] References Cited

U.S. PATENT DOCUMENTS

| | | | |
|---|---|---|---|
| 337,559 | 3/1886 | Cole | 451/552 |
| 816,599 | 4/1906 | Pippy | 451/552 |
| 858,307 | 6/1907 | Reed | 76/81.3 |
| 955,265 | 4/1910 | Hayne et al. | 451/552 |
| 1,294,616 | 2/1919 | Carlson | 451/552 |
| 1,708,006 | 4/1929 | Aske | 451/556 |
| 1,935,592 | 11/1933 | Stivers | 451/554 |
| 2,324,498 | 7/1943 | Emmert | 451/556 |
| 2,347,246 | 4/1944 | Barrett | 451/556 |
| 2,458,443 | 1/1949 | Stemland | 451/556 |
| 3,229,425 | 1/1966 | Homeyer | 451/552 |
| 3,640,447 | 2/1972 | Forbes, Jr. et al. | 206/216 |
| 4,122,887 | 10/1978 | Dussault et al. | 160/354 |
| 4,344,475 | 8/1982 | Frey | 160/135 |
| 4,594,816 | 6/1986 | Goldstein | 451/524 |
| 4,667,829 | 5/1987 | Edmund-White | 206/216 |
| 4,815,591 | 3/1989 | Tivy | 206/223 |
| 4,991,357 | 2/1991 | Stickles, Sr. | 451/552 |
| 5,344,039 | 9/1994 | Taniyama | 220/520 |
| 5,398,868 | 3/1995 | Densen | 229/125.08 |
| 5,405,000 | 4/1995 | Hagedon et al. | 206/216 |

*Primary Examiner*—Bruce M. Kisliuk
*Assistant Examiner*—Dona C. Edwards
*Attorney, Agent, or Firm*—Knobbe, Martens, Olson & Bear

[57] ABSTRACT

A container assembly for a sharpening stone which can be converted from a package for transport and display into a pedestal for supporting and exposing the sharpening stone for use. The assembly is formed of a sheet of polymeric material having a plurality of panels joined by living hinges. A generally box-shaped package can be formed for containing the sharpening stone by folding the panels in one direction and joining end flaps and panels by the use of detents. A pedestal for exposing the sharpening stone can be formed by folding the respective panels on the assembly in the opposite direction and joining into a box-shaped configuration with the use of the end flaps, panels and detents.

22 Claims, 6 Drawing Sheets

PACKAGE/PEDESTAL FOR SHARPENING STONE

FIELD OF THE INVENTION

The present invention relates to a sharpening stone container and, more particularly, to a package for a sharpening stone convertible to a pedestal for the stone.

BACKGROUND OF THE INVENTION

Sharpening stones, or hones, are typically provided as relatively thick elongated slabs having a large, flat upper surface on which blades can be sharpened. The use of the term "sharpening stone" can pertain to conventional solid abrasive stones or, in a more modern sense, to any strong solid material having an abrasive surface layer. In recent years industrial grade diamonds have proliferated on the world market, in the process becoming less expensive, and are often preferred for forming an abrasive coating or layer on grinding wheels and other sharpening devices. Accordingly, relatively brittle solid sharpening stones of the past may be replaced by rectangular bars of steel covered with a coating of abrasive industrial grade diamonds.

When sharpening a knife or other instrument, the angle at which the blade is held with respect to the sharpening surface is critical. The angle must be held relatively constant while the blade is rubbed over the sharpening surface otherwise ineffective or uneven sharpening will occur. There have been numerous designs in the past to provide holders or stands for sharpening stones to ensure a correct angle is ground into the blade. For example, U.S. Pat. No. 4,991,357 to Stickles, Sr. discloses a knife-sharpening kit wherein a sharpening stone is mounted between a pair of angled support surfaces on which the blade rests during sharpening. The kit is provided with a separate hollow cover to protect the sharpening stone when not in use.

Although devices for holding the blade at a certain angle have been in use for many years, the most popular sharpening stones remain the simple flat surface so that the person sharpening the blade can adjust the angle and with care produce a fine sharp edge. There have been attempts at providing a container for such flat stones which can render them portable and which are openable to expose the stone to sharpening. Such containers may be seen in U.S. Pat. No. 337,559 to Cole, U.S. Pat. No. 816,559 to Pippy, and U.S. Pat. No. 2,324,498 to Emmert. The Cole and Pippy oil stone holders are relatively bulky and intended for use with a lubricating oil with oil receptacles provided. Specifically, the lower portion of the Cole holder contains oil, while the lid of the Pippy box when inverted underneath the stone catches excess oil from around the sides of the holder. The device of Emmert is a relatively flimsy embossed paper sheet having the hone attached to inner surfaces. Another attempt at providing a portable protective container for an abrasive stone is shown in U.S. Pat. No. 329,425 to Homeyer. An endless band of rubber surrounds the stone and may be peeled back and folded underneath to provide a non-slip base when sharpening.

Despite the aforementioned attempts, there is still a need for a portable, lightweight, and relatively simple device for containing sharpening stones and exposing them for use in sharpening blades.

SUMMARY OF THE INVENTION

The present invention provides an improved container system for sharpening stones wherein the system is convertible from a sharpening stone package to a pedestal for supporting the sharpening stone in use. The system includes the sharpening stone and a sheet element having a plurality of panels and end flaps joined by living hinges. The sheet can be folded into two box-shaped configurations to provide the package or pedestal for the sharpening stone. In this respect, the sharpening stone is adapted to be mounted to one surface of one of two main panels sized slightly larger than the sharpening stone. An intermediate panel connects the main panels at hinges, while a closure flap is hingedly attached to an edge of one of the main panels opposite the intermediate panel. The closure flap includes at least one latch member adapted to mate with a second latch member on the second main panel.

In the preferred embodiment, the panels and flaps are rectangular and the box-shaped configurations have right-angle corners. In either box-shaped configuration, the two main panels lie parallel to each other with narrow panels and flaps forming side walls of the box. The living hinges can be bent at least 90° in either direction so that the surface of the main panel on which the sharpening stone is mounted can be facing either to the interior of the box to contain the stone, or to the exterior to expose the stone for sharpening.

In a preferred configuration, the sheet element includes a first rectangular main panel and a second rectangular main panel, adjacent long edges of the main panels being joined to a narrow intermediate panel by living hinges. The second panel includes an elongated closure flap attached by a living hinge to a long edge opposite the intermediate panel connecting edge. A pair of opposed side flaps are also attached by living hinges to the remaining free edges of the second panel. The sheet element may be folded into two boxes with the first and second panels disposed parallel to one another, the intermediate panel and the closure flap parallel to one another, and the end flaps parallel to one another. By rotating each connected component 180° with respect to its adjacent component, the box can be inverted to change from a sharpening stone package to a sharpening stone pedestal, or visa versa.

The preferred embodiment includes a simple detent-style locking arrangement which maintains the integrity of either box configuration and adds to the rigidity of the entire structure. Specifically, the closure flap includes at least one and preferably two closure tabs adapted to mate with notches formed in an edge of the first panel. Each closure tab comprises a narrow neck portion sized approximately equal to the length of the notches, and an outer locking portion wider than the neck portion and spaced from the closure flap, the neck and locking portions being T-shaped. The first panel includes an interrupted series of enlarged or bulbed edge segments adjacent the notches having a thickness greater than a gap between the locking portion and a free edge of the closure flap. In forming either the package or pedestal box-shaped configuration, the bulbed edge segments are forced between the locking portion and the edge of the closure flap until the neck portion is in the notch. The bulbed edge segments have a thickness sufficient to interfere with the T-shaped closure tab to prevent the closure flap from separating from the first panel. In addition, the first panel preferably includes bulbed side edges which interfere with the side flaps attached to the second panel. Preferably the side flaps have a short outwardly projecting tab for interfering with the bulbed edge segments. In this manner, when the first panel is positioned parallel to the second panel, the side flaps are bent almost 90° with respect to the second panel and the projected tabs cammed past the bulbed edge segments to retain the side flaps within the confines of the package or pedestal.

In accordance with a method of alternatively storing and supporting a sharpening stone for use, the stone is enclosed within a first box-shaped configuration which can be reversed to form a second box-shaped configuration exposing the stone. More particularly, the sharpening stone is confined within the first box-shaped configuration formed by a sheet having a first main panel and a second main panel joined along adjacent edges by hinges to an intermediate panel. The first panel has a first latch member formed on an edge opposite the intermediate panel and the sharpening stone is mounted on an interior surface of the second panel.

To convert to a support pedestal for the sharpening stone, a second latch member of a closure flap joined to an edge of the second panel opposite the intermediate panel with a third hinge is unlatched from the first latch member. The hinges are pivoted so that the first and second panels form top and bottom walls and the intermediate panel and the closure flap form side walls of the pedestal. Again, the closure flap is latched to the second panel by mating the first latch member with the second latch member.

To convert back to the first box-shaped configuration enclosing the sharpening stone from the second box-shaped configuration exposing the sharpening stone, the closure flap is unlatched from the second panel and the hinges are pivoted. The closure flap is re-latched to the second panel by mating the first latch member with the second latch member.

DESCRIPTION OF THE PREFERRED EMBODIMENTS

Figure 1:
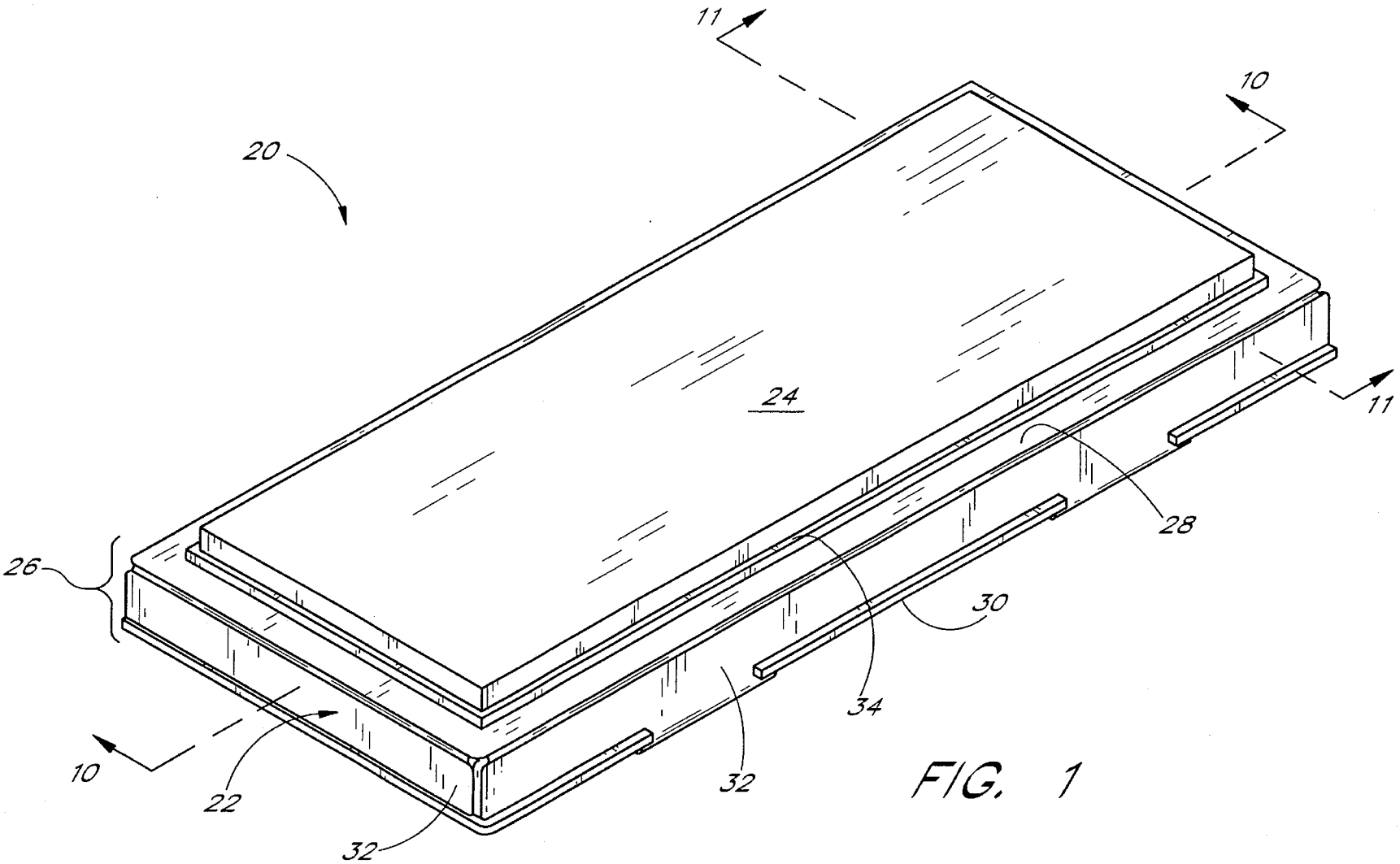
FIG. 1 is a perspective view of a package/pedestal assembly of the present invention formed into a pedestal for a sharpening stone.

As seen in perspective in FIG. 1, a knife sharpening system 20 of the present invention comprises a package/pedestal assembly 22 and a sharpening stone 24. The system 20 is intended to provide an enclosure or container for the sharpening stone 24 which can be folded open into a non-slip support base or pedestal 26 for the stone, as in the illustration of FIG. 1. The package/pedestal assembly 22 is preferably formed as a single sheet of material having a number of panels with hinges therebetween (FIGS. 2–4) which can be assembled into two box-shaped structures; a package 36 (FIGS. 7–9) containing the sharpening stone 24, and the pedestal 26 exposing and supporting the sharpening stone for use in sharpening blades or other instruments.

The pedestal 26 includes a top wall 28, a bottom wall 30, and a plurality of side walls 32 hingedly attached at their upper edges to the top wall and in interlocking engagement at their lower edges with the bottom wall. The sharpening stone 24 is attached to or otherwise securely positioned in the center of the top wall 30 facing up. Preferably, the sharpening stone 24 is attached within the confines of a generally rectangular shaped rail 34 which provides transverse support against movement generated by the forces imparted by a person sharpening a blade on the top of the stone.

In the present invention, the sharpening stone 24 may be of several varieties, including a solid piece of abrasive stone or other material, or a composite assembly with at least one rigid base layer and at least one abrasive layer. More particularly, the present invention is particularly suited for sharpening stones 24 made of rectangular slabs of steel having an abrasive coating of industrial grade diamonds on its upper surface. The abrasive character of the diamond coating can be varied from very fine to extremely coarse and, in fact, more than one region on the upper surface of the stone can be coated with differing coarseness of abrasive material. In short, the present invention is not intended to be limited by the type of sharpening stone 24 utilized.

Figure 2:
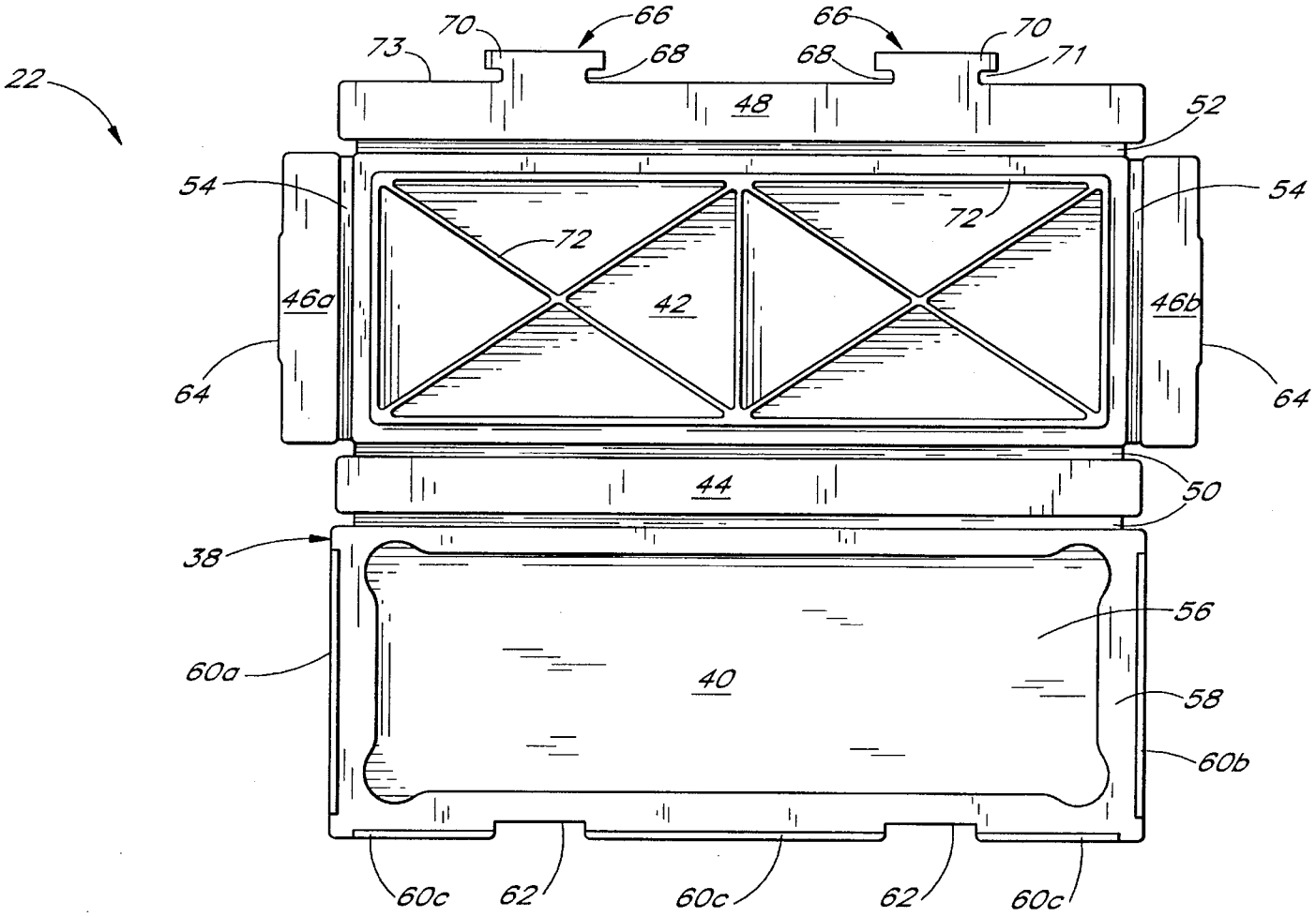
FIG. 2 is an unfolded plan view of a sheet used in forming the package/pedestal assembly of the present is folded into a box-shaped package.
Figure 3:
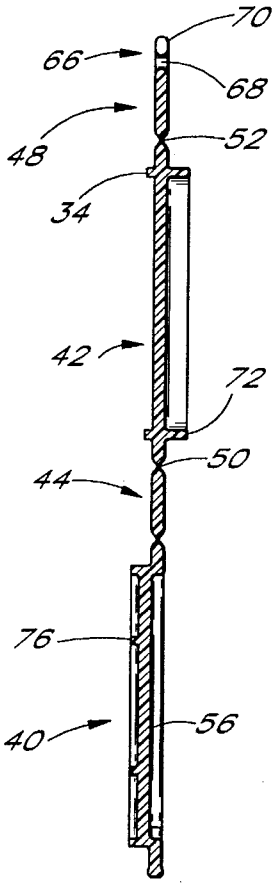
FIG. 3 is a cross-sectional view of the sheet taken along line 3—3 of FIG. 4.
Figure 4:
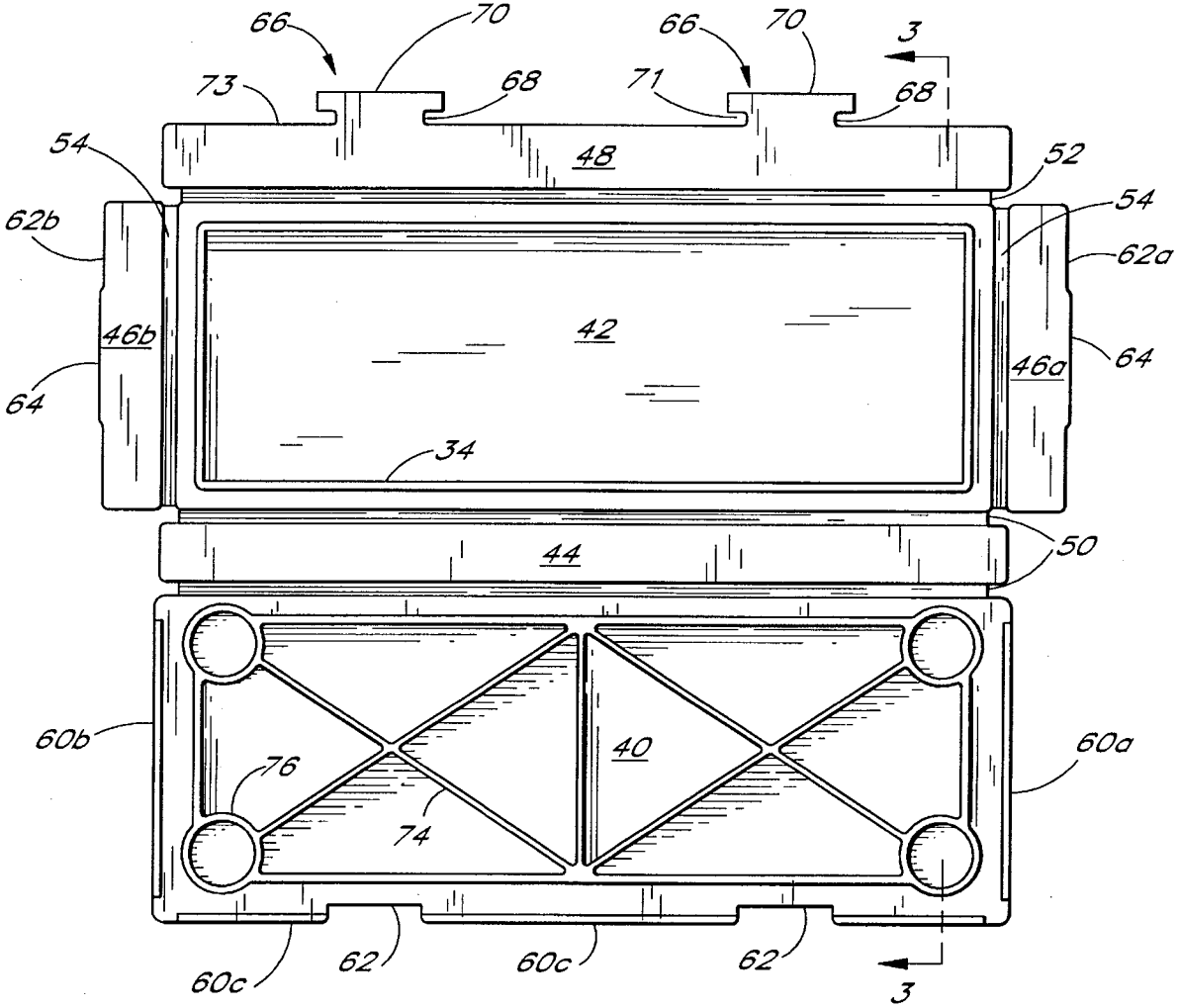
FIG. 4 is a plan view of the sheet showing surfaces which face inward when the sheet is folded into a box-shaped package.

The package/pedestal assembly 22 will now be described in detail with reference to the unfolded plan and end views of FIGS. 2–4. FIG. 2 shows a single sheet 38 of material used for the assembly 22 unfolded exposing the surface which is outside when the sheet is folded to form a package (the "package surface"), while FIG. 4 is an unfolded view exposing the surface which is outside when the sheet is folded to form a pedestal (the "pedestal surface").

The sheet 38 is segregated into a first rectangular panel 40, a second panel 42 approximately the same size as the first panel, an elongated intermediate panel 44 between the first and second panels, a pair of side flaps **46*a*, 46*b*, and a front or closure flap 48. The intermediate panel 44 is connected on both its longitudinal edges to the first and second panels 40, 42 via living hinges 50. The closure flap 48 is connected to a long edge of the second panel 42 opposite the intermediate panel 44 via a living hinge 52. Likewise, the side flaps 46*a*, 46*b* are connected to the short edges of the second panel 42 via living hinges 54. It should be noted that the single sheet 38 connected by living hinges 50, 52, 54** is a preferred embodiment only and the box-shaped configurations could be formed from separate panels joined at mechanical hinges.

Figure 5:
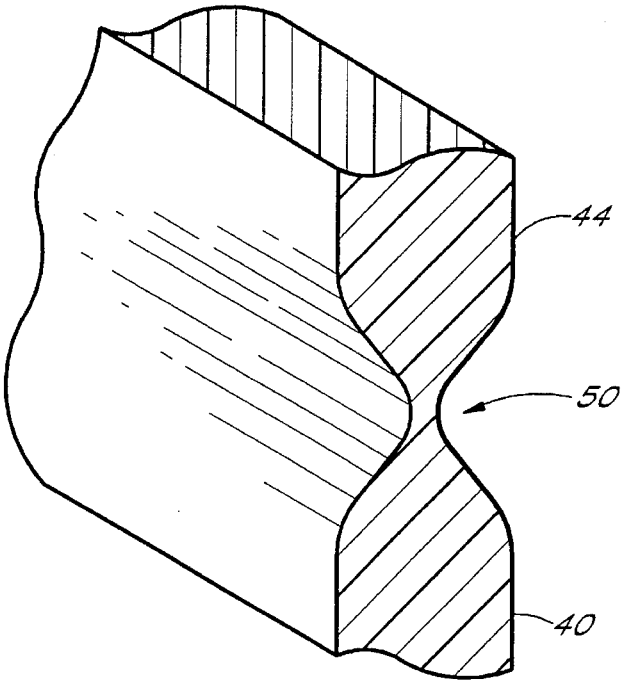
FIG. 5 is a detailed perspective view of one of the preferred living hinges formed in the sheet of FIGS. 2–4.

Living hinges in this respect refer to regions in the integral sheet 38 which are narrowed or otherwise adapted for providing hinged movement between the components they connect. As best seen in FIG. 3, and the detail of FIG. 5, each living hinge comprises regions of between 10% and 15% of the thickness of the sheet 38, the narrow region being centered in the plane of the sheet to provide equal flexibility in either direction. For durability, the narrowed regions are formed by rounded V-indentations on either side of the sheet, the indentations having a relatively shallow included angle so that either connected panel can be bent at least 180° with respect to the other panel. Preferably, the included angle of the V-indentations is at least 90° and more preferably is approximately 100°.

With reference to FIG. 2, the package surface of the first panel 40 comprises a central generally rectangular shaped depression 56 surrounded by a flat perimeter portion 58 having a plurality of bulbed edge segments 60*a*, 60*b* and 60*c*. More particularly, the first panel 40 includes two opposed bulbed edge segments 60*a*, 60*b* extending nearly the entire width of each of the short edges of the rectangle. Further, the first panel 40 includes an interrupted bulbed edge segment 60*c* formed in three parts in the long edge of the panel and separated by a pair of latch members in the form of generally rectangular notches 62. The functions of the bulbed edge segments 60*a,b,c* and notches 62 in forming either the pedestal 26 or package 36 will be described in more detail below.

The intermediate panel 44 is formed as a rectangle whose narrow dimension generally defines the height of the pedestal 26 or package 36. Similarly, the side flaps 46*a*, 46*b* and closure flap 48 include main body portions having narrow dimensions which are identical to the narrow dimensions of the intermediate panel 44. In addition to the rectangular main body portion, the side flaps 46*a*, 46*b* include centered slightly projecting edge tabs 64. The closure flap 48 includes a pair of outwardly projecting T-shaped closure latches or tabs 66 defined by a neck portion 68 and a locking portion 70. The neck portion 68 is sized approximately equal to the width of the notches 62 in the first panel 40, while the locking portion 70 extends outward in wings to define a gap 71 with a free edge 73 of the closure flap 48. The package surface of the second panel 42 includes a plurality of raised reinforcing ridges 72 which lie at right angles and in cross configurations. The package surface of the second panel 42 will form the bottom wall of the package 36, and thus the raised ridges 72 function as feet to elevate the body of the package above a supporting surface.

Now turning to the pedestal surface of the sheet 38, as seen in FIG. 4, the first panel 40 has a plurality of reinforcing ridges 74 formed therein defining corner circles 76 for locating nonslip feet 78 (FIGS. 8–11) for the pedestal 26. The aforementioned bulbed edge segments 60*a*, 60*b*, 60*c*, of the package surface are identically formed on the pedestal surface of the first panel 40. The pedestal surface of the second panel 42 includes the aforementioned rectangular rail 34 whose interior dimensions are sized either identical to or slightly smaller than the sharpening stone 24. When the assembly 22 is formed into the pedestal 26 shown in FIG. 1, the pedestal surface of the first panel 40 faces a support surface. The nonslip circular feet 78 thus provide support and frictional contact with the support surface to facilitate sharpening of a blade on the stone 24. The non-slip feet 78 may be rubber disks or other highly frictional material and are bonded within the circles 76.

Figure 6:
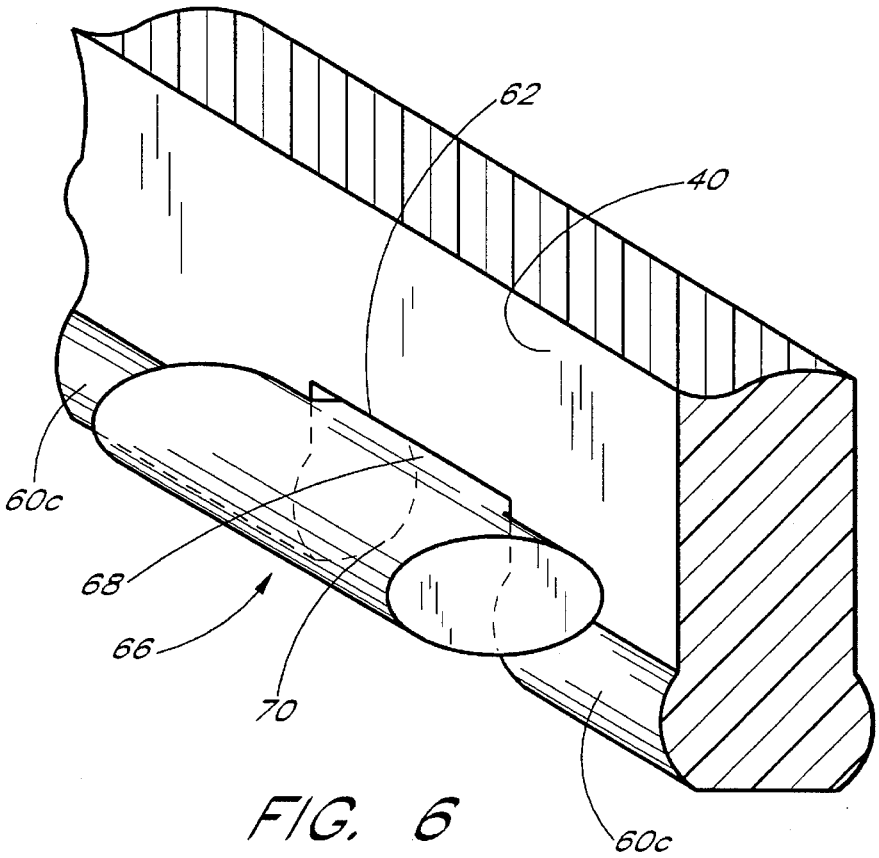
FIG. 6 is a detailed perspective view of one embodiment of a latch configuration for securely forming the box-shaped package or pedestal.

The bulbed edge segments 60*a*, 60*b*, 60*c* are seen in greater detail in FIG. 6 and comprise symmetrical rounded protuberances on the first panel 40 edges having thicknesses greater than the thickness of the planar first panel. Desirably, the thickness of each bulbed edge segment 60 is approximately 20% greater than the thickness of the first panel 40. These edge segments 60*a,b,c* act as detents in closing or otherwise constructing either the pedestal 26 or package 36, and may be referred to as such below.

Figure 7:
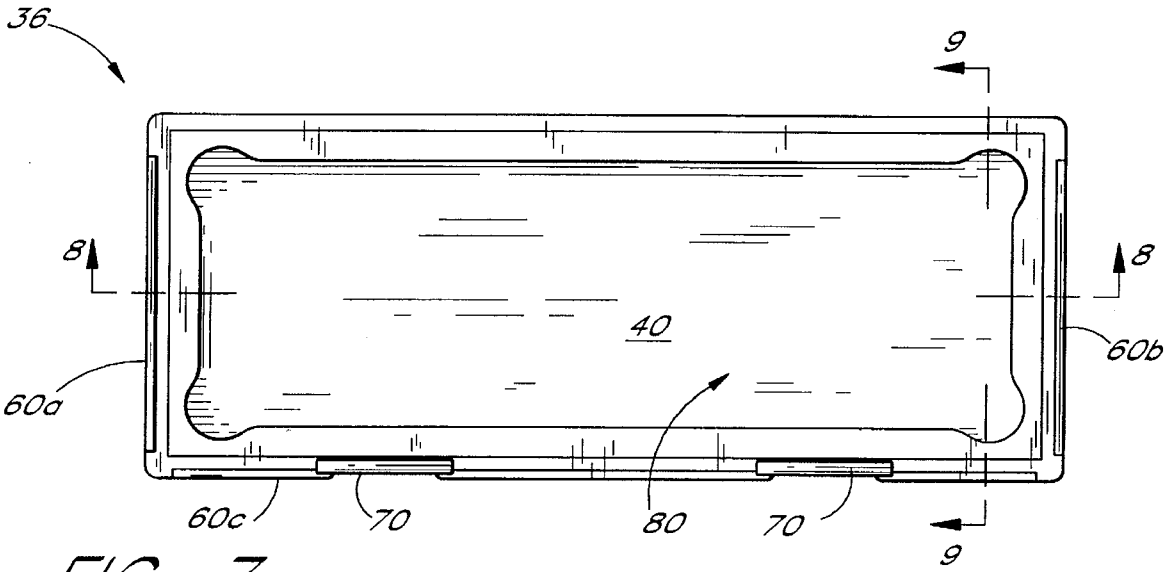
FIG. 7 is a top plan view of a package containing the sharpening stone.

Now with reference to FIG. 7, a plan view of the assembly 22 constructed into a closed package 36 is shown. Cross-sectional views of the package 36 can be seen in FIGS. 8 and 9. In the package mode, the first panel 40 forms a top wall 80 while the second panel 42 forms a bottom wall 82. To form the package 36 the sheet 38 is bent 90° at the hinges 50, 52 and 54 so that the pedestal surfaces seen in FIG. 4 are, in fact, on the interior and face an inner space 84. The first and second panels 40, 42 are folded to lie generally parallel and the locking portions 70 of the closure tabs 66 are forced over the interrupted edge segment 60*c* so that the neck portion 68 fits within the notches 62. This closure is seen best in FIG. 6 whereby the locking portion 70 is captured by the edge segments 60*c*. Although the latching members on the closure flap 48 and first panel 40 are depicted as interlocking tabs and notches, other latches known by those skilled in the art may be used. For further stability, the end flaps 46*a,b* are pressed inward until the projecting edge tabs 64 are forced past the detents 60*a,b* on the first panel 40.

Figure 9:
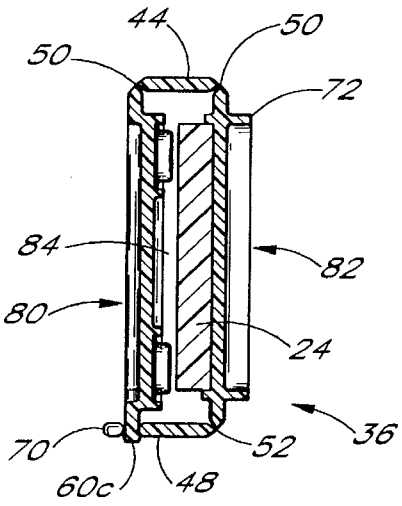
FIG. 9 is a transverse sectional view of the package of FIG. 7 taken along line 9—9
Figure 8:
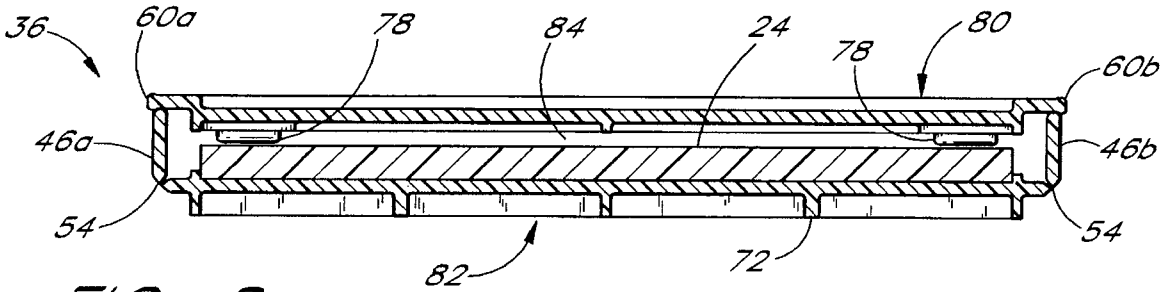
FIG. 8 is a cross section through the centerline of the package of FIG. 7 taken along line 8—8.

The sharpening stone 24 is securely held within the enclosing package 36 on the pedestal surface of the second panel 42. The downwardly depending ridges 72 provide rigidity for the second panel 42 to support the weight of the sharpening stone 24 without significant bowing. As seen in FIGS. 8 and 9, the nonslip feet project into the interior space 84 of the package 36 so that there is a slight gap between the sharpening stone 24 and the feet. Of course, the assembly can be manufactured without such a gap therebetween.

Figure 10:
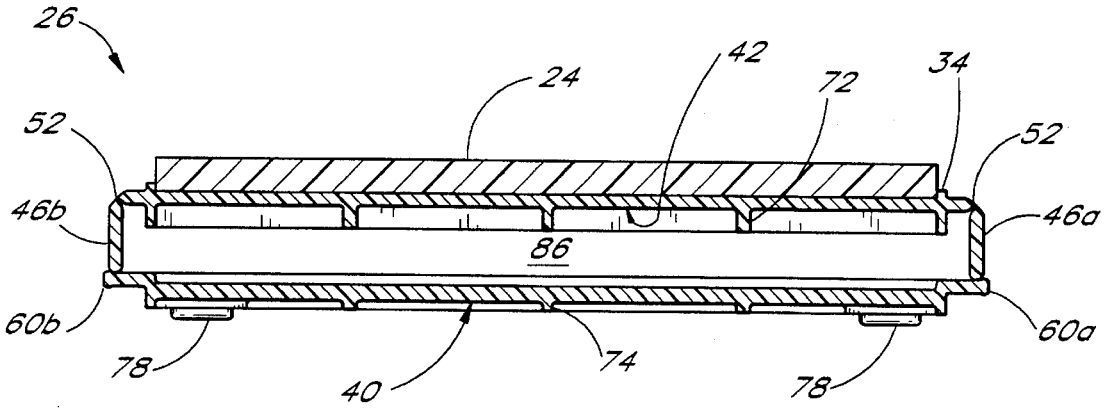
FIG. 10 is a cross-sectional view through the centerline of the pedestal of FIG. 1 taken along line 10—10.
Figure 11:
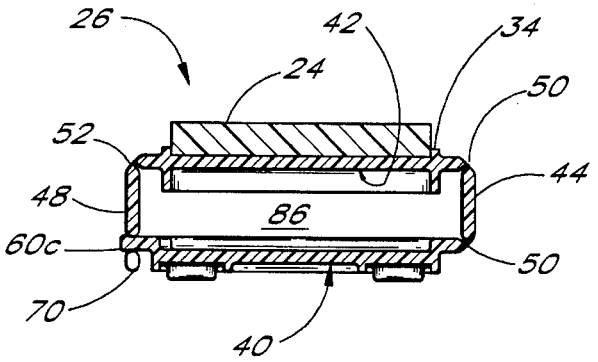
FIG. 11 is a transverse sectional view of the pedestal of FIG. 1 taken along line 11—11.

Now with reference to FIGS. 1, 10 and 11, the assembly 22 is shown as formed into a pedestal 26 for the sharpening stone 24. In this configuration, the sheet 38 is bent back upon itself so that the package surface seen in FIG. 2 faces an interior space 86 of the box-shaped pedestal 26. Again, the locking portions 70 are forced over the interrupted edge segment 60*c* so that the neck portion 68 of the closure tab 66 fits within the notches 62, as seen in FIG. 11. Further, the end flaps 46*a*, 46*b* are pressed inward so that the projecting edge tabs 64 are forced past the bulbed edge segments or detents 60*a*, 60*b*, as seen in FIG. 10. The sharpening stone 24 is thus supported above the pedestal 26 for sharpening blades thereon.

In either the pedestal mode or the package mode, the assembly 22 forms a sturdy, rigid box for either containing or supporting the sharpening stone 24. The first and second panels 40, 42 both include reinforcing ridges which add stability and resist bending. This is particularly important when utilizing the sharpening stone 24 on top of the second panel 42 in the pedestal mode. Further, in either mode, the side flaps 46*a,b* and closure flap 48 are securely interlocked within the bulbed edge segments 60*a,b,c*. Indeed, the cooperation of the closure tabs 66 and notches 62 form a lock for maintaining the box-shaped configuration of either the pedestal 26 or package 36. Moreover, the preferred sheet 38 is made of 0.1" thick polypropylene, which provides sufficient strength and rigidity, especially when formed in the small dimension boxes described herein. The nonslip feet 78 also add to the structural integrity of the pedestal 26 by preventing lateral movement on a support surface. Finally, the entire weight of the sheet 38 is minimized due to the preferred polymer material, and thus the system 20 weighs only slightly more than the sharpening stone 24 itself.

The present package/pedestal assembly 22 is preferably formed of polypropylene or other appropriate polymer which is lightweight and provides long life for the living hinges. In one preferred embodiment, the overall length of the assembly 22 in either the pedestal 26 or package 36 mode is approximately 6¾", while the overall width is approximately 2¾". The approximate height of the pedestal 26, including the height of a preferred 2"×6" diamond-coated steel sharpening stone 24, is approximately 1.13". The height of the package 36 is approximately 0.9". The nominal thickness of the sheet 38 in the preferred embodiment is approximately 0.1". The assembly 22 is preferably injection molded and all of the exposed corners except for the notches 62 are preferably rounded for aesthetic and wear reasons.

Although this invention has been described in terms of certain preferred embodiments, other embodiments that are apparent to those of ordinary skill in the art are also within the scope of this invention. Accordingly, the scope of the invention is intended to be defined by the claims which follow.

I claim:

1. A system for packaging a sharpening stone and for supporting said stone on a base surface, comprising:

a sheet having a first main panel and a second main panel joined along adjacent edges by first and second hinges to an intermediate panel, said first panel having at least a first latch member formed on an edge opposite said intermediate panel;

a closure flap joined to an edge of said second panel opposite said intermediate panel with a third hinge, said closure flap including at least a second latch member for mating with said first latch member, said first, second and third hinges capable of allowing rotational movement of the respective elements connected at the hinges in either direction out of the plane of the sheet so that two box-shaped configurations can be formed by said sheet with said first and second panels forming top and bottom walls and said intermediate panel and said closure flap forming sidewalls; and a sharpening stone mounted on a surface of one of said first and second panels so that in a first box-shaped configuration the stone is enclosed while in a second box-shaped configuration the stone is exposed, the other of said first and second panels on which the sharpening stone is not mounted having a first surface which is configured to rest on a support in said second box-shaped configuration, said first surface facing said sharpening stone in said first box-shaped configuration and facing away from said stone in said second box-shaped configuration.

2. The system of claim 1, wherein one of said first and second latch members comprises a notch and the other of said first and second latch members comprises a locking tab sized to mate with said notch.

3. The system of claim 1, wherein one of said first and second panels includes at least one bulbed edge segment to the side of each of said first latch members so that said second latch member must be forced past said bulbed edge segment for said second latch member to mate with said first latch member.

4. The system of claim 3, wherein one of said first and second latch members comprises a notch in the edge opposite said intermediate panel and said other of said first and second latch members comprises a T-shaped locking tab sized to mate with said notch defined by a neck portion and a locking portion extending on either side of said neck portion, said neck portion being sized approximately equal to the length of said notch, said locking portion forming a gap smaller than the thickness of said bulbed edge segments, and wherein said locking tab mates with said notch by forcing said bulbed edge segments through said gap so that said neck portion resides within said notch.

5. The system of claim 4, wherein said bulbed edge segments are centered in the plane of said one of said first and second panels and have a thickness approximately 20% greater than said one panel.

6. The system of claim 1, further comprising a pair of opposed end flaps joined to edges of one of said first and second panels with fourth and fifth hinges.

7. The system of claim 6, wherein the other of said first and second panels further comprises opposed bulbed edge segments which cooperate with said end flaps in either box-shaped configuration to retain said end flaps within the outline of said box-shaped configuration.

8. The system of claim 7, wherein said bulbed edge segments are centered in the plane of said other panel and have a thickness approximately 20% greater than said other panel.

9. The system of claim 1, wherein one of said first and second panels includes a rail on one surface sized to receive said sharpening stone.

10. The system of claim 9, wherein said one panel includes a plurality of reinforcing ridges on a surface opposite said one surface for stiffening said one panel.

11. The system of claim 9, wherein said sharpening stone is mounted within said rail of said one panel and the sharpening stone is exposed above said one panel in said second box-shaped configuration.

12. The system of claim 1, wherein one of said first and second panels includes a plurality of reinforcing ridges on one surface which define receptacles, said system including a plurality of non-slip feet mounted in said receptacles for contacting a support surface when said system is formed into said second box-shaped configuration.

13. The system of claim 1, wherein said hinges are living hinges defined by narrowed portions in said sheet.

14. The system of claim 13, wherein said living hinges are defined by centered narrowed portions in said sheet formed in rounded V-indentations having an included angle on either side of the sheet of at least 90°.

15. The system of claim 1, wherein said main panels are rectangular.

16. The system of claim 1, wherein said sheet is formed as an integral member.

17. The system of claim 1, wherein said sheet is constructed of polypropylene.

18. A method of storing and supporting a sharpening stone for use, comprising the steps of:

enclosing the sharpening stone within a first box-shaped configuration formed by a sheet having a first main panel and a second main panel joined along adjacent edges by first and second hinges to an intermediate panel, said sharpening stone being mounted on a surface of one of said first and second main panels so that in said first box-shaped configuration said sharpening stone faces a first surface on the other main panel on which the sharpening stone is not mounted;

latching an edge of said first panel to a closure flap on said second panel opposite said intermediate panel;

unlatching said closure flap;

forming a second box-shaped configuration from said sheet exposing said sharpening stone by pivoting said first, second and third hinges, said first and second panels forming top and bottom walls and said intermediate panel and said closure flap forming sidewalls, said first surface facing away from said sharpening stone in said second box-shaped configuration; and latching said closure flap to said first panel in said second box-shaped configuration.

19. The method of claim 18, further comprising the steps of:

converting said second box-shaped configuration exposing said sharpening stone into said first box-shaped configuration enclosing said sharpening stone by unlatching said closure flap from said first panel;

pivoting said first, second and third hinges; and re-latching said closure flap to said first panel.

20. The method of claim 19, wherein said latching steps and said re-latching step comprise:

forcing a latch member on one of said closure flap or first panel into a notch on the other of said closure flap or first panel.

21. The method of claim 18, further comprising the step of:

forming side walls for said second box-shaped configuration by pivoting a pair of opposed end flaps joined to edges of one of said first and second panels about fourth and fifth hinges.

22. The method of claim 21, wherein said forming step comprises the step of:

forcing said end flaps past bulbed edge segments in the other of said first and second panels to retain said end flaps within the outline of said second box-shaped configuration.

* * * * *